US007407161B2

(12) United States Patent
White

(10) Patent No.: US 7,407,161 B2
(45) Date of Patent: Aug. 5, 2008

(54) METHOD OF AND ASSEMBLY FOR LAPPING CONSECUTIVE SHEETS OF WEB MATERIAL

(75) Inventor: Barton J. White, Freedom, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 555 days.

(21) Appl. No.: 10/953,175

(22) Filed: Sep. 29, 2004

(65) Prior Publication Data

US 2005/0073090 A1 Apr. 7, 2005

Related U.S. Application Data

(60) Provisional application No. 60/507,792, filed on Oct. 1, 2003.

(51) Int. Cl.
*B65H 5/34* (2006.01)

(52) U.S. Cl. ..... 271/270; 271/276; 271/182; 271/314

(58) Field of Classification Search ..... 271/270, 271/276, 182, 183, 314; 221/49; 493/405, 493/408, 416, 433, 435
See application file for complete search history.

(56) References Cited

U.S. PATENT DOCUMENTS

| | | | | |
|---|---|---|---|---|
| 1,624,985 | A | 4/1927 | Sheldon | |
| 1,886,312 | A | 11/1932 | Stanton | |
| 2,092,952 | A | 9/1937 | Campbell | |
| 3,096,977 | A | 7/1963 | Winkler et al. | |
| 3,338,575 | A | 8/1967 | Nystrand et al. | |
| 3,490,762 | A | 1/1970 | Nystrand | |
| 4,163,548 | A | 8/1979 | Nystrand | |
| 4,254,947 | A | 3/1981 | Trogan | |
| 4,279,411 | A | 7/1981 | Nystrand | |
| 4,708,332 | A | 11/1987 | Besemann | |
| 4,991,831 | A | 2/1991 | Green | |
| 4,995,600 | A | 2/1991 | Kovac et al. | |
| 5,090,671 | A | 2/1992 | Gombault et al. | |
| 5,899,447 | A | 5/1999 | Muckenfuhs | |
| 6,090,467 | A | 7/2000 | Yip | |
| 6,165,116 | A | 12/2000 | White | |
| 6,270,067 | B1 | 8/2001 | Bergmann et al. | |
| 7,121,994 | B2 * | 10/2006 | Haasl | 493/442 |
| 2005/0070419 | A1 * | 3/2005 | Haasl | 493/435 |

FOREIGN PATENT DOCUMENTS

| | | |
|---|---|---|
| EP | 1 555 986 | 4/2001 |
| EP | 1 371 593 | 12/2003 |

* cited by examiner

*Primary Examiner*—David H Bollinger

(57) ABSTRACT

A mechanism for offsetting or overlapping successive sheets of material in an interfolding machine includes a bed roll rotating at a first speed and a retard roll rotating at a slower, second speed and positioned adjacent the bed roll. As successive sheets are transferred from the bed roll to the retard roll, the sheets are engaged by a nip roller assembly positioned adjacent the retard roll and forming a nip through which the sheets pass. The retard roller forms a deflection or bubble in the individual sheet passing through the nip, which enables a successive sheet to be positioned beneath the previous sheet, thereby forming the overlap of the successive sheet with the previous sheet.

15 Claims, 6 Drawing Sheets

METHOD OF AND ASSEMBLY FOR LAPPING CONSECUTIVE SHEETS OF WEB MATERIAL

RELATED APPLICATIONS

This application claims the benefit under 35 U.S.C. § 119 (e) of U.S. Provisional Application Ser. No. 60/507,792, filed Oct. 1, 2003, the entirety of which is hereby incorporated herein by reference.

FIELD OF THE INVENTION

The present invention relates to interfolding processes for sheet-type material, and more specifically to an assembly for overlapping sheets of material to create or form an interfolded stack of sheets.

BACKGROUND OF THE INVENTION

In order to form a stack of interfold sheets of material, the sheets of material forming the stack must be offset or lapped such that each individual sheet can be folded and releasably engaged with adjacent sheets. In order to lap the sheets within a interfolding machine, a number of different processes have been developed. In the majority of these processes, problems arise in that the mechanisms utilized to lap the sheets are overly complicated or the mechanisms do not function appropriately to properly offset the sheets in a generally continuous manner for an extended period of time.

Therefore, it is desirable to develop a machine and method for lapping consecutive sheets of material which overcomes the deficiencies of known offsetting mechanisms in the prior art for interfolding sheets of material.

SUMMARY OF THE INVENTION

In accordance with one aspect of the invention, an assembly for overlapping a first sheet of material with a successive second sheet of material generally includes a first roll rotating at a first speed and a second roll positioned adjacent the first roll and rotating at a second speed slower than the first speed, to retard the speed of advancement of the sheets. The assembly further includes a roller assembly positioned adjacent to the second roll and operable to cooperate with the first and second rolls to form an overlap of the second sheet with the first sheet.

In one embodiment of an interfolding machine in accordance with the invention, the first roll is the bed roll of a which cooperates with a knife roll to sever the web material into sheets, and the second roll is a retard roll located adjacent the bed roll. First and second sheets of material are held to a circumference of the first and second rolls by a vacuum at a plurality of passages extending radially to the circumference of the first and second rolls. The roller assembly, referred to as a "nip" roller assembly, is located adjacent the second roll, i.e. the retard roll, of the interfolding machine. The nip roller assembly operates to provide positive control of the leading edge of the sheet while the trailing edge of the sheet is being pulled out of the way by the bed roll. The nip roller assembly ensures that registration of the leading edge of the sheet is not lost while the trailing edge of the sheet is peeled off of the bedroll. Previous machines that do not have a nip roller assembly, as in the present invention, suffer from a battle between vacuum holes of the retard roll and the bedroll during this lapping process, which can cause the leading edge of the sheet to slip after the transfer of the leading edge off the bedroll to the retard roll and while the rest of the sheet is being pulled temporarily out of the way to allow the upstream sheet to move ahead to achieve the overlap with the downstream sheet. The overlapped sheets of material are transferred to folding rollers located downstream of the nip roller assembly. The folding rollers fold the overlapped sheets of material into a desired interfolded stack of sheets.

In one embodiment, the nip roller assembly generally includes one or more wheels, each of which is rotatably mounted to an outer end defined by a pin. The nip roller assembly further includes a housing, and an inner end defined by each pin is mounted to the housing via a stop that secures the pin in the housing. The stop is preferably adjustably coupled at the inner end of the pin. The nip roller assembly further includes a collar mounted to the pin, and a compression spring mounted on the pin and disposed between the collar and the housing. A shroud is positioned adjacent to the one or more wheels. The shroud includes one or more openings to receive a portion of the circumference of the one or more wheels. The preferred shroud includes a generally U-shaped plate structure having a first leg and a second leg to receive the one or more wheels therebetween. The shroud extends generally parallel to the first and second rolls. The U-shaped shroud includes a generally curvilinear portion to receive a trailing edge of the first and second sheets, and a generally linear portion opposite the generally curvilinear portion. This configuration allows the roller assembly to be easily adjusted to engage the sheets of material in varying locations, in order to provide an offset or overlap of varying lengths to accommodate varying interfolded stack configurations and sheets of various types.

Another aspect of the invention provides an interfolding machine for interfolding sheets of material. The interfolding machine generally includes a cutting assembly, such as a knife roll, to cut the material against a bed roll into a series of sheets including a first sheet and a successive second sheet. The interfolding machine further includes an overlap assembly operable to form an overlap of the first sheet with a successive second sheet of material. The overlap assembly generally includes a first roll rotating at a first speed, a second roll positioned adjacent the first roll and rotating at a second speed slower than the first speed; and a nip roller assembly positioned adjacent to the second roll. As noted previously, the nip roller assembly operates to provide positive control of the leading edge of the sheet while the trailing edge of the sheet is being pulled out of the way by the bed roll, to ensure that registration of the leading edge of the sheet is not lost while the trailing edge is peeled off of the bedroll. The interfolding machine further includes a first and a second folding roll that receive the sheets of material from the overlap assembly. The first and second folding rolls are configured to form a fold in the sheets of material so as to create a desired interfolded stack of sheets.

Yet another aspect of the invention provides a method of overlapping a first sheet of material with a successive second sheet of material. The method includes the steps of supplying the first and second sheets to a first roll rotating at a first speed; transferring a leading edge of the first sheet from the first roll to a second roll rotating at a second speed slower than the first speed; providing positive control of the leading edge of the sheet via a nip roller assembly that cooperates with the second roll, while the trailing edge of the sheet is being advanced by an upstream roll; subsequently transferring a leading edge of the successive second sheet along the first roll into engagement with the second roll using the nip roller assembly; holding a trailing edge of the first sheet with the roller assembly as the second roll moves the leading edge of the second sheet beneath the trailing edge of the first sheet; and disengaging the trailing edge of the first sheet from the roller assembly and into engagement with the second sheet positioned beneath.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings.

DETAILED DESCRIPTION OF THE INVENTION

Figure 1:
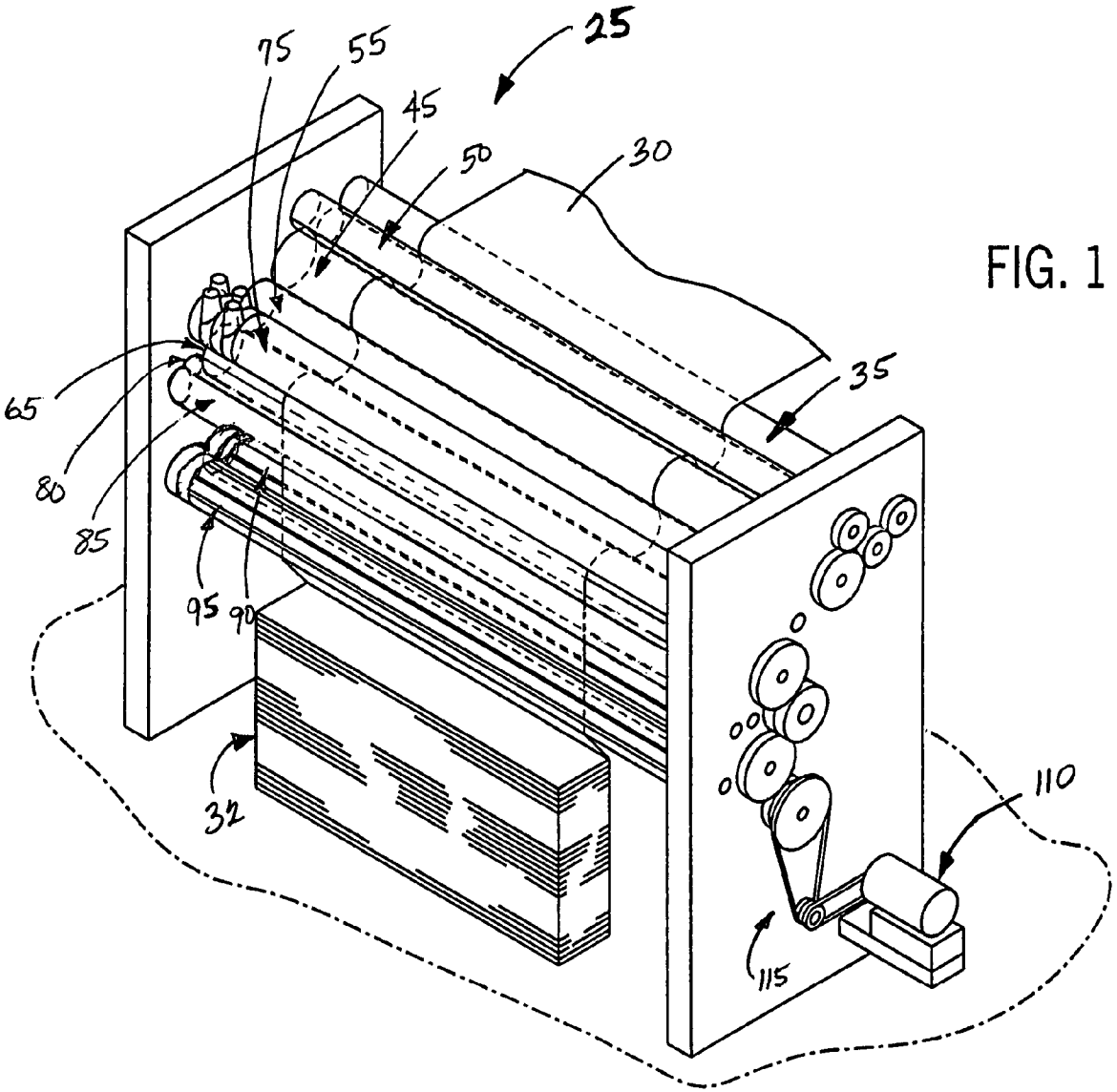
FIG. 1 is an isometric view of an interfolding machine employing an overlap assembly in accordance with the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected" or terms similar thereto are often used. Such terms are not limited to direct connection but include connection through other elements where such connection is recognized as being equivalent by those skilled in the art.

1. Interfolding Machine

Figure 2:
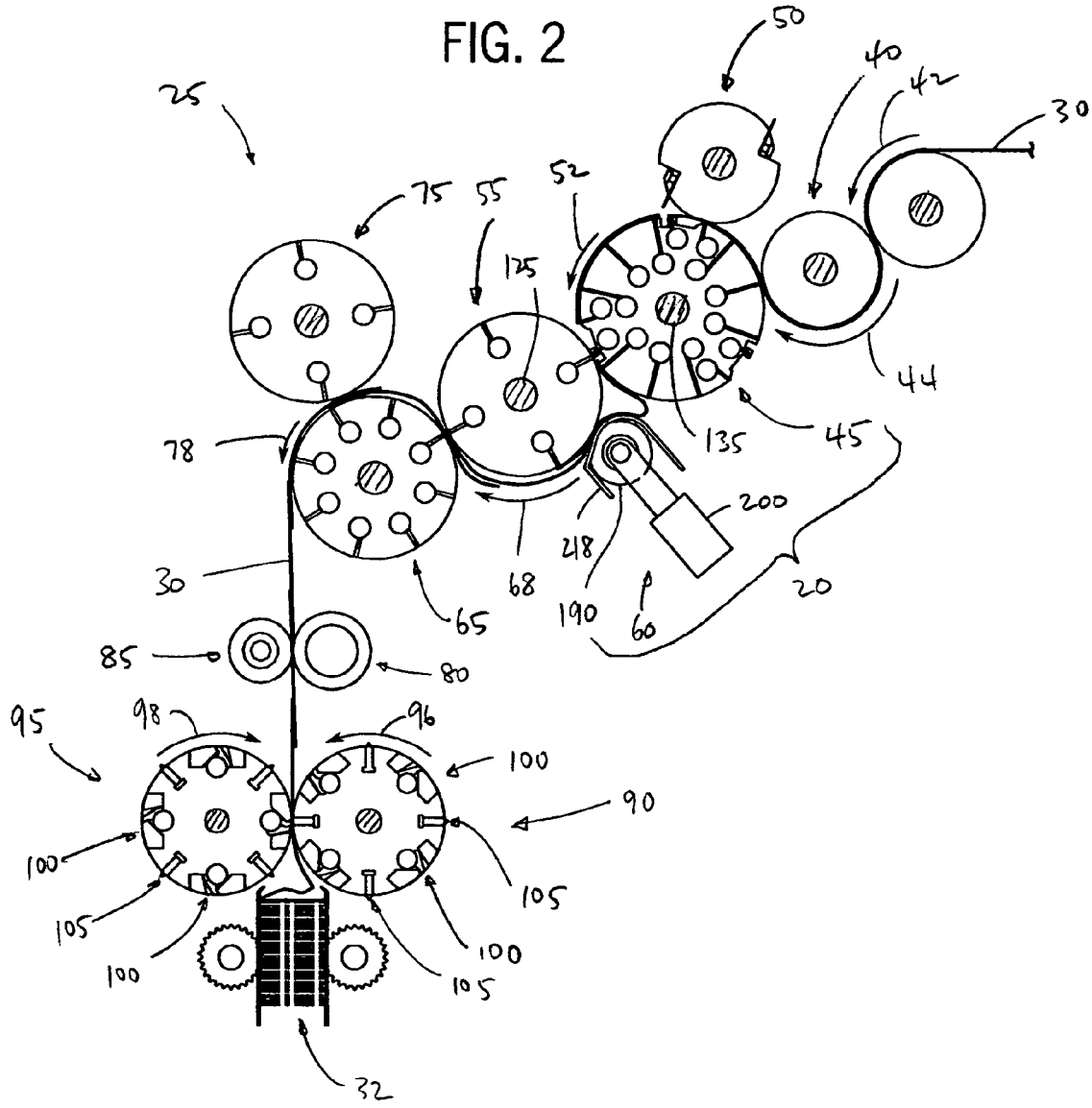
FIG. 2 is a schematic side elevation view of the interfolding machine and overlap assembly as shown in FIG. 1.

Referring to FIGS. 1 and 2, an interfolding machine 25 is operable to convert a web of material 30 into a stack of interfolded sheets of material shown at 32. Interfolding machine 25 incorporates the nip roller overlap assembly of the present invention, and generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner to be explained, the retard roll 55 cooperates with a nip roller assembly 60 (FIG. 2) in accordance with the present invention to form an overlap between the consecutive sheets of material. The retard roll 55 carries the overlapped sheets of material along a path (illustrated by arrow 68 in FIG. 2) to a lap roll 65.

The lap roll 65 works in combination with a count roll 75 to eliminate the overlap between adjacent sheets of material at a predetermined sheet count, so as to create a separation in the stack 32 of interfolded sheets discharged from the interfolding machine 25. The lap roll 55 carries the overlapped sheets of material 30 along a path (illustrated by arrow 78 in FIG. 2) toward a nip defined between a first assist roll 80 and an adjacent second assist roll 85. The first and second assist rolls 80 and 85 feed the sheets of the material to a nip defined between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of the material therebetween. The periphery of the first folding roll 90 generally includes a series of the gripper assemblies 100 and a series of tucker assemblies 105 uniformly and alternately spaced to interact with a series of gripper and tucker assemblies 100 and 105, respectively, of the adjacent second folding roll 95. The series of alternately spaced gripper assemblies 100 and tucker assemblies 105 of the first and second folding rolls 90 and 95 interact to grip, carry, and release the sheets of material in a desired manner so as to form the desired interfolded relationship in the sheets of material and to form stack 32 of interfolded sheets. The folding rolls 90 and 95 may be driven by a drive system 110 having a drive belt assembly 115 (FIG. 1).

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in copending application Ser. No. 10/610,458 filed Jun. 30, 2003, the disclosure of which is also hereby incorporated herein by reference in its entirety.

2. Overlap Assembly

Referring to FIGS. 2-5, the overlap assembly 20 in accordance with the present invention generally includes the retard roll 55, the bed roll 45, and the nip roll assembly 60. Retard roll 55 is mounted to a shaft 125 that rotates in a counter-clockwise direction (illustrated by arrow 68) and is positioned adjacent to the bed roll 45. Bed roll 45 is mounted on a shaft 135 that rotates in a counter-clockwise direction (illustrated by arrow 52). The speed of rotation of the shaft 125 and the retard roll 55 is approximately two-thirds of the speed of rotation of the shaft 135 and the bed roll 45, for reasons which will later be explained. A gap 140 is defined between the retard roll 55 and bed roll 45, and is dimensioned such that a consecutive series of sheets, such as shown at 145*a* and 145*b* having respective leading edges 150*a* and 150*b* and trailing edges 155*a* and 155*b*, can pass between the retard roll 55 and the bed roll 45.

The consecutive sheets such as 145*a* and 145*b* are initially held on the bed roll 45 by a number of radial suction passages 160, each of which is connected by an axial vacuum passage 165 to a vacuum source (not shown), in a manner as is known. The vacuum supplied through the axial passages 165 and radial passages 160 serves to hold the sheets such as 145*a* and 145*b* at the circumference of the bed roll 45 as the bed roll 45 rotates in the counterclockwise direction 52. As the leading edges 150*a* and 150*b* of sheets 145*a* and 145*b*, respectively, are rotated into the nip or gap 140 between the bed roll 45 and the retard roll 55, the leading edges 150*a* and 150*b* are simultaneously disengaged by the suction passages 160 of the bed roll 45 and are engaged by one of a series of radial suction passages 170 formed in the retard roll 55. The retard roll suction passages 170 are connected to a series of axial vacuum passages 175, which are also connected to the vacuum source described above in a manner as is known. The retard roll suction passages 170 engage and hold the leading edges of the sheets, such as 150*a* and 150*b* downstream of the nip or gap 140, while the remainder of each sheet located upstream of the nip or gap 140 is maintained in engagement with bed roll 45 via a bed roll suction passage 160 that engages the trailing edge of each sheet. The bed roll suction passages 160 that engage the trailing edge of each sheet are supplied with vacuum to a point in the rotation of bed roll 45 downstream of nip or gap 140, to maintain each sheet trailing edge in engagement with bed roll 45 downstream of nip or gap 140.

In order to form or create the offset or overlap of successive sheets, the leading edge such as 150*b* of each upstream sheet such as 145*b* is positioned forwardly of the trailing edge such as 155*a* of the next adjacent downstream sheet such as 145*a*. To accomplish this, the nip roller assembly 60 includes a series of nip rolls 185 which are positioned adjacent the retard roll 55 and spaced apart from the bed roll 45. Each nip roll 185 is formed of a rubber covered idler wheel 190 affixed to one end of an idler pin 195, and is located immediately adjacent to the retard roll 55. Each idler pin 195 is supported by a housing 200. Each pin 195 is held in engagement with the housing 200 by an adjustable stop 205 and a compression spring 210. The adjustable stop 205 is secured to the end of the pin 195 opposite the wheel 190. The compression spring 210 is located opposite the stop 205 and is disposed between the housing 200 and a collar 215. The nip roll assembly 60 also includes a shroud 218 positioned around the wheels 190 in order to ensure that the bubble created by the differential in speed between the bed roll 45 and the retard roll 55 is not prematurely sucked into the nip created by the retard rollers 185 and the retard roll 55. The shroud 218 includes a series of spaced slots 219, and each nip roll 185 extends through one of slots 219 so as to face retard roll 55 and to form a nip or gap 220 therebetween.

Figure 3:
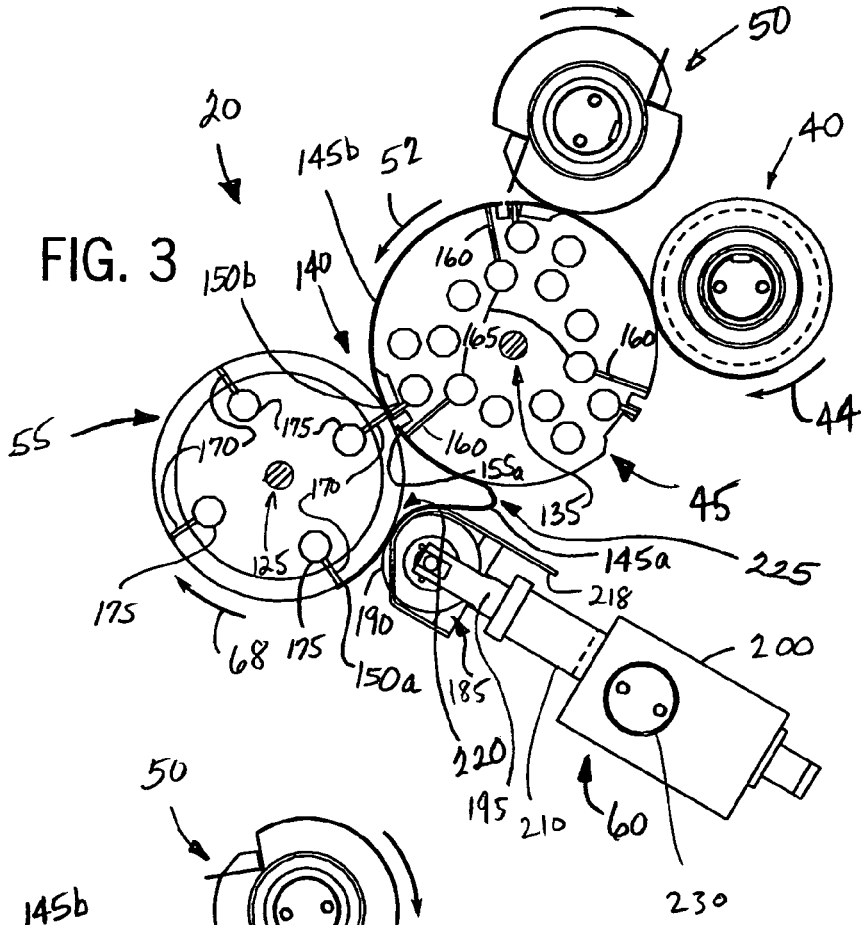
FIGS. 3-5 are enlarged partial side elevation views showing a portion of the interfolding machine of FIG. 2 and the nip roller overlap assembly of the present invention, and illustrating sequential advancement of sheets of material and operation of the nip roller overlap assembly to overlap the sheets of material.

In operation, the leading edge 150*a* of a downstream sheet 145*a* is engaged with retard roll 55 via vacuum supplied to one of retard roll vacuum passages 170. When the leading edge 150*a* enters the nip 220 formed by the retard roll 55 and nip rolls 185, the leading edge 150*a* is firmly held on the retard roll 55 by suction passages 170. Due to the difference in rotational speed between the retard roll 55 and the bed roll 45 (with the retard roll 55 rotating at a slower speed than the bed roll 45), the leading edge 150*a* moves toward the nip 220 at a rate slower than the rate of advancement of the trailing edge 155*a*, which is retained in engagement on the bed roll 45 by one of the bed roll vacuum passages 160. This difference in the rate of advancement of the sheet 145 consequently forms a deflection or bubble 225 in the sheet 145 at a location upstream of nip rolls 185, as shown in FIG. 3. The presence of the deflection 225 enables the leading edge 150*b* of the successive sheet 145*b* to move along the bed roll 45 into engagement with the retard roll 55 via another of retard roll vacuum passages 170, so that the leading edge 150*b* of sheet 145*b* is positioned beneath the trailing edge 155*a* of the previous sheet 145*a*.

Figure 4:
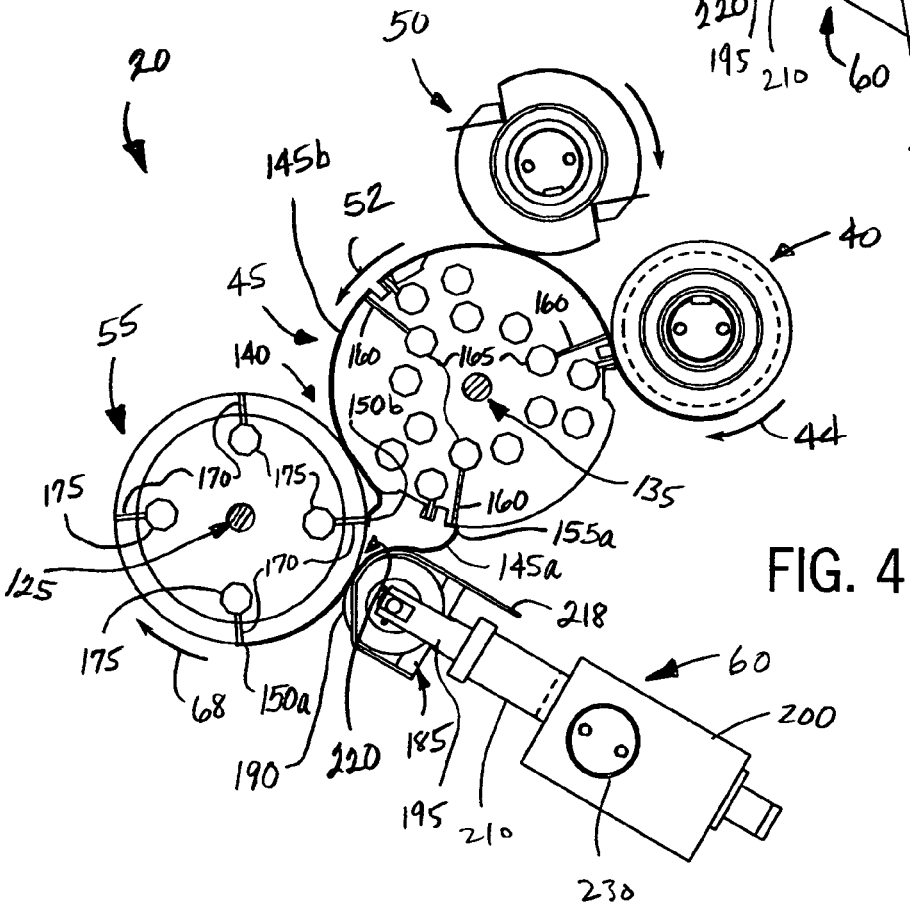
Figure 5:
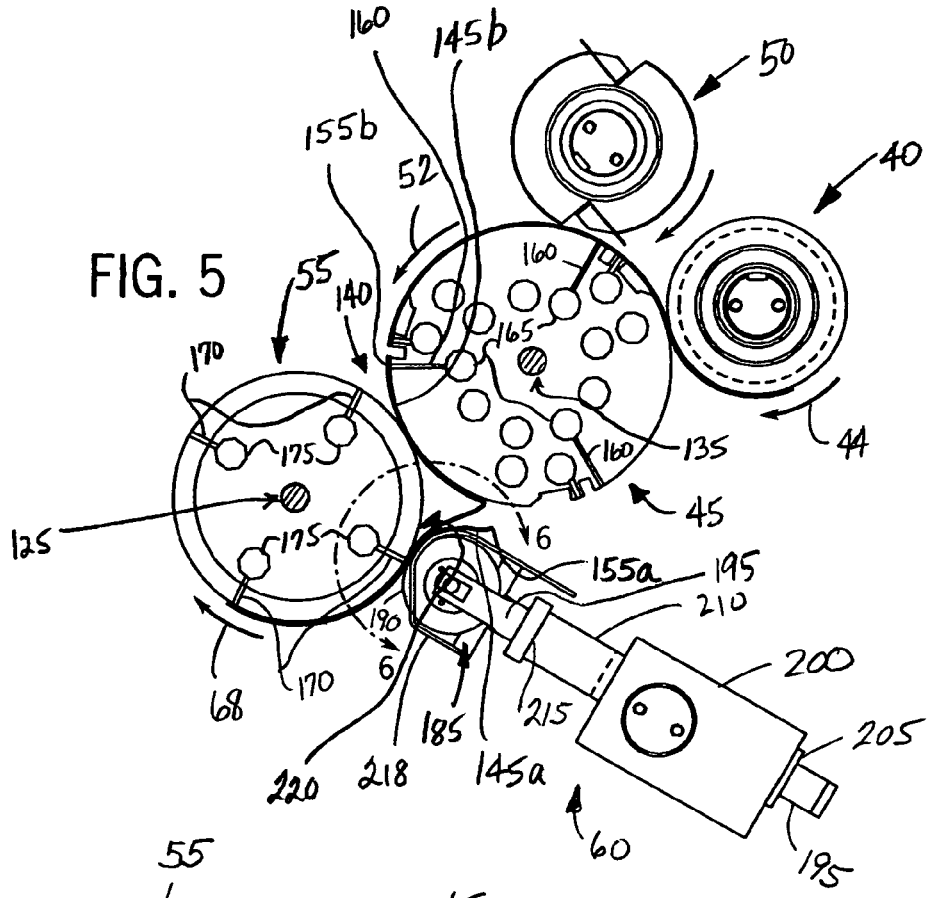
Figure 6:
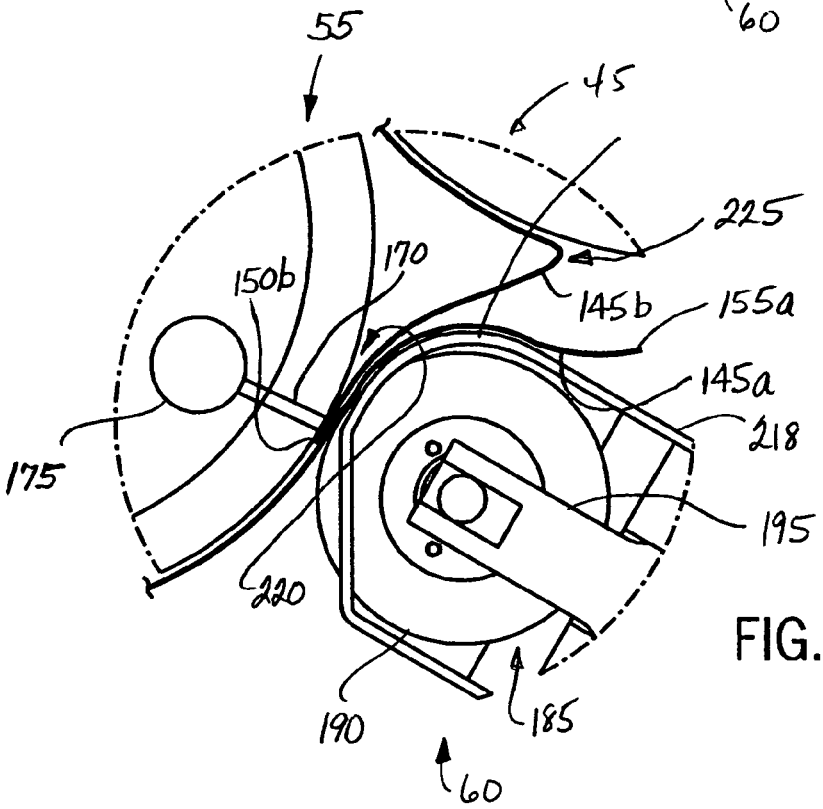
FIG. 6 is an enlarged partial side elevation view with reference to line 6-6 of FIG. 5, showing interaction of the nip roller overlap assembly of the present invention with one of the sheets of material and the bed roll and retard roll of the interfolding machine.
Figure 7:
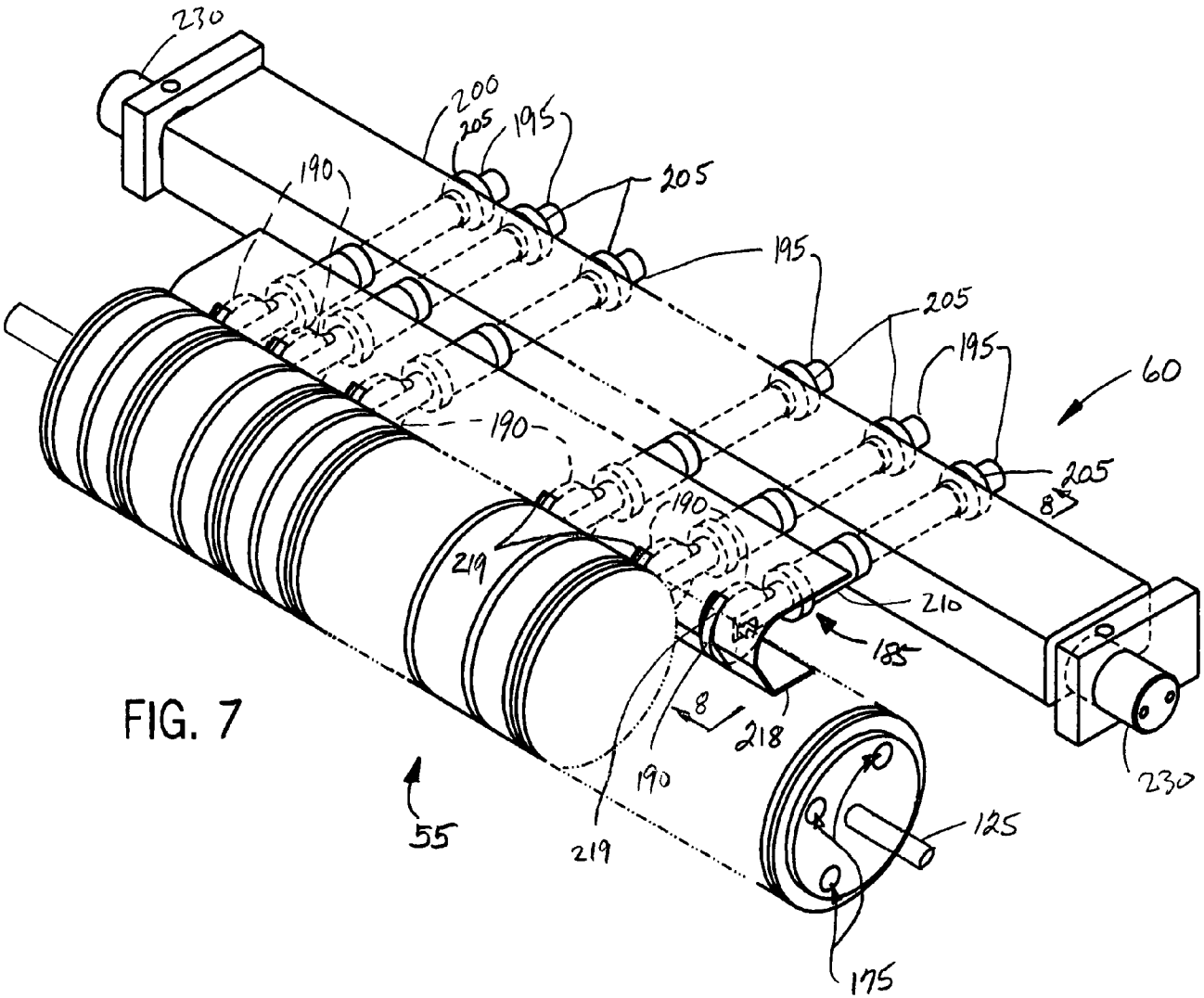
FIG. 7 is an isometric view of the nip roller overlap assembly shown in FIGS. 2-6 in combination with the retard roll of the interfolding machine.

As shown in FIGS. 4 and 5, the trailing edge 155*a* of the downstream sheet 145*a* is maintained on the bed roll 130 during continued advancement by rotation of bed roll 45, and is then released or disengaged from the bed roll 45 when bed roll 45 reaches a predetermined point in its rotation. Such continued movement of sheet 145*a* first reduces and then eliminates deflection or bubble 225 in its entirety, when the trailing edge 155*a* of sheet 145*a* is released from engagement with bed roll 45. The trailing edge 155*a* then falls into contact with the shroud 218 and is directed toward and through the nip 220. Simultaneously, the leading edge 150*b* of the upstream sheet 145*b* is advanced toward nip 220 by virtue of its engagement with retard roll 55 via retard roll vacuum passage 170, which results in the formation of an overlap between sheets 145*a* and 145*b* in the area between the leading edge 150*b* of sheet 145*b* and the trailing edge 155*a* of sheet 145*a*, as shown in FIG. 6. During such advancement of the upstream sheet 145*b*, the trailing edge 155*b* of the upstream sheet 145*b* remains in engagement with bed roll 45, causing the formation of a deflection or bubble 225 in sheet 145*b*, in the same manner as described previously with respect to sheet 145*a*. This process is continuously repeated during advancement of successive sheets, so as to produce a stream of overlapped sheets 145*a*, 145*b*, etc. that are supplied to lap roll 65 (FIG. 2). The shroud 218 is designed to prevent the bubble or deflection 225 in each sheet from passing into the nip created between the retard roll nip roller 185 and the retard roll 55 until the bed roll 45 has pulled the trailing end of sheet completely out of the way, and maintains the sheet bubble or deflection 225 intact until the trailing end of the sheet is advanced to a location at which it is released from engagement with bed roll 45.

Figure 8:
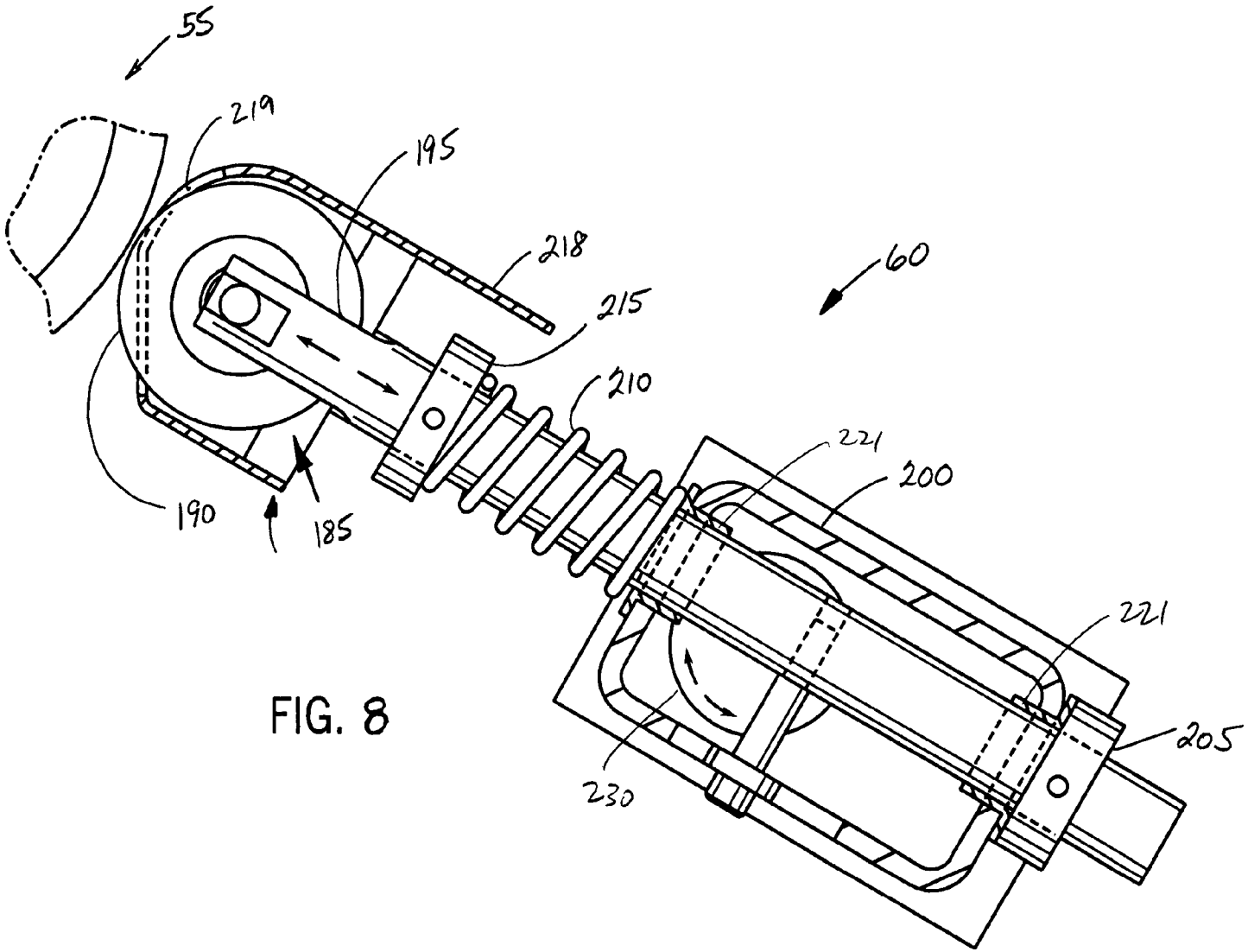
FIG. 8 is an enlarged cross-sectional view taken along line 8-8 of FIG. 7.

In order to enable adjustment in the force applied by the nip rolls 185 to hold the sheet leading edges such as 150*a*, 150*b* in the nip 220, and to accommodate any variations in the diameter of retard roll 55 in the location of nip rolls 185, the idler pins 195 are slidably mounted within the housing 200 for movement toward and away from retard roll 55. As shown in FIG. 8, the position of stop 205 on idler pin 195 can be adjusted, to ensure that each nip roll 185 provides the desired dimension of nip 220 between retard roll 55 and nip roll 185. Idler pin 195 extends through a pair of bushings or collars 221, which are mounted within aligned openings in opposite walls of housing 200 and which accommodate such axial adjustment in the position of idler pin 185 relative to housing 200. Compression spring 210 applies an axial biasing force on idler pin 195 that urges idler pin 195 toward the surface of retard roll 55. In addition, compression spring 210 can be compressed in the event an obstruction passes through nip 220, to enable nip rolls 185 to temporarily move away from the surface of retard roll 55. It can thus be appreciated that spring 210 consistently urges the wheel 190 towards the retard roll 55 with a generally constant amount of force, with a minimum or desired distance between the wheel 190 and the retard roll 55 forming the nip 220 maintained by the location of the stop 205 on the idler pin 195.

Further, in order to vary the position of nip 220 defined by the nip roll 185 as necessary, e.g. due to varying shapes and/or sizes of the sheet(s) 145, the housing 200 is mounted on a pivot 230 defined by a pair of stub shafts that extend outwardly from the opposite ends of housing 200. Pivot 230 enables the idler pins 195 to pivot, which varies the position of the idler wheels relative to the circumference of retard roll 55, to thereby enable adjustment in the position of nip roll 185 relative to bed roll 55. When the position of idler pins 195 is adjusted in this manner, the length of idler pin 195 outwardly of housing 200 is adjusted by means of stop 205, to provide precise control of the dimension of nip 220 between nip rolls 185 and retard roll 55.

While the invention has been shown and described with respect to a specific embodiment, it is understood that a wide variety of machines or systems could be constructed in accordance with the invention defined by the claims. Hence, although the exemplary embodiment of an overlap assembly 20 in accordance with the invention is generally described with reference to a interfolding machine 25 for folding sheets of material into a zig-zagged interfolded stack 32, the application of the nip roller assembly 20 is not limited to this particular type of machine. The nip roller assembly 20 of the invention could be employed to overlap or stagger sheets of material being fed for a wide variety of uses by various machines, and the specific embodiment and application as illustrated is not limiting on the invention.

The above discussion, examples, and embodiments illustrate my current understanding of the invention. However, since many variations of the invention can be made without departing from the spirit and scope of the invention, the invention resides wholly in the claims hereafter appended.

I claim:

1. An assembly for lapping a first sheet of material with a consecutive second sheet of a material, comprising:

a first roll rotating at a first speed for conveying sheets of material along a feed path;

a second roll positioned adjacent the first roll along the feed path and rotating at a second speed; and a roller assembly positioned proximate the second roll along the feed path such that a nip is defined with the second roll, wherein the first roll feeds a sheet of material along the feed path such that the leading end of the sheet is fed into the nip while maintaining the sheet in engagement with the first roll and wherein the nip engages the leading edge of the sheet with the second roll while the trailing edge of the sheet remains in engagement with the first roll; and wherein the roller assembly is movable relative to the second roll so as to vary the location of the nip relative to the surface of the second roll.

2. The assembly as recited in claim 1, wherein the first and second rolls each include a plurality of radially extending passages leading to a circumference defined by each of the first and second rolls, and wherein the successive first and second sheets of material are held at the circumference of the first and second rolls by a vacuum at the radially extending passages.

3. The assembly as recited in claim 1, wherein the roller assembly comprises:

one or more wheels;

a pin that supports each of the wheels, each pin having a first end and a second end, wherein a wheel is mounted to the first end of each pin; and a housing configured to mount the pins.

4. The assembly as recited in claim 3, wherein the roller assembly further includes:

a collar mounted to each pin; and a compression spring mounted on the pin and disposed between the collar and the housing for biasing the wheel toward the second roll.

5. The assembly as recited in claim 3, further comprising an adjustable position stop interconnected with each pin and engaged with the housing for adjustably mounting each pin.

6. The assembly as recited in claim 3, wherein the nip roll assembly further includes a shroud positioned adjacent to the one or more wheels, the shroud including one or more openings to receive a portion of the circumference of each of the one or more wheels.

7. The assembly as recited in claim 6, wherein the shroud includes a generally U-shaped plate structure having a first leg and a second leg to receive the one or more wheels therebetween.

8. The assembly as recited in claim 6, wherein the shroud includes a generally curvilinear portion and a generally linear portion adjacent to the second roll, the curvilinear portion configured to receive a trailing edge of the first sheet and the overlapping portion of an adjacent second sheet, the linear portion configured to disengage the trailing edge of the first sheet from the shroud.

9. The assembly as recited in claim 3, wherein the housing is mounted on a pivot which allows the roller assembly to rotate and adjustably position the wheel in relation to the second roll.

10. A method for overlapping a first sheet of material and a successive second sheet of material using a first roll and a second roll, the method comprising the acts of:

defining a desired nip location by adjusting a position of a roller assembly relative to the second roll, wherein the roller assembly is located adjacent the second roll;

supplying the first and second sheets to the first roll rotating at a first speed;

transferring a leading edge of the first sheet from the first roll to the second roll rotating at a second speed slower than the first speed;

creating a deflection in the first sheet using the roller assembly;

transferring a leading edge of the successive second sheet along the first roll into engagement with the second roll;

holding a trailing edge of the first sheet with the roller assembly as the second roll moves the leading edge of the second sheet beneath the trailing edge of the first sheet; and disengaging the trailing edge of the first sheet from the roller assembly into engagement with the second sheet positioned beneath.

11. The method as recited in claim 10, wherein the act of creating the deflection in the first sheet includes:

holding the leading edge of the first sheet between the second roll and a series of wheels forming a part of the roller assembly; and holding the trailing edge of the first sheet with the first roll.

12. The method as recited in claim 11, wherein the act of holding the leading edge of the first sheet between the second roll and the series of wheels of the roller assembly includes applying an adjustable force to the series of wheels that holds the leading edge of the first sheet in a nip defined by a distance between the second roll and the wheels of the roller assembly.

13. An assembly for lapping a first sheet of material with a consecutive second sheet of a material, comprising:

a first roll rotating at a first speed for conveying sheets of material along a feed path;

a second roll positioned adjacent the first roll along the feed path and rotating at a second speed;

a roller assembly positioned proximate the second roll along the feed path and including a roller arrangement that defines a nip with the second roll, wherein the first roll feeds a sheet of material along the feed path such that the leading end of the sheet is fed into the nip while maintaining the sheet in engagement with the first roll and wherein the nip engages the leading edge of the sheet with the second roll while the trailing edge of the sheet remains in engagement with the first roll; and a stationary guide member associated with the roller assembly, wherein at least a portion of the stationary guide member overlies the roller arrangement of the roller assembly and wherein the guide member is configured to guide the sheets into the nip between the second roll and the roller arrangement.

14. The assembly of claim 13 wherein the roller arrangement includes a plurality of nip rollers positioned adjacent the second roll and spaced from the first roll, and wherein the stationary member comprises a shroud positioned around the nip rollers.

15. The assembly of claim 14 wherein the shroud includes a plurality of spaced slots and wherein each nip roller extends through a respective one of the spaced slots.

* * * * *